US008678846B2

(12) United States Patent
Hitchcock et al.

(10) Patent No.: US 8,678,846 B2
(45) Date of Patent: Mar. 25, 2014

(54) ELECTRICAL CONNECTOR WITH CONNECTOR POSITION ASSURANCE DEVICE

(75) Inventors: Matthew Bryan Hitchcock, Harrisburg, PA (US); Bradley Scott Buchter, East Berlin, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 56 days.

(21) Appl. No.: 13/432,906

(22) Filed: Mar. 28, 2012

(65) Prior Publication Data

US 2013/0260590 A1 Oct. 3, 2013

(51) Int. Cl.
*H01R 13/627* (2006.01)

(52) U.S. Cl.
USPC ..... 439/352; 439/489

(58) Field of Classification Search
USPC ..... 439/350, 352, 353, 354, 357, 358, 488, 439/489, 595, 752
See application file for complete search history.

(56) References Cited

U.S. PATENT DOCUMENTS 5,928,038 A 7/1999 Berg et al.
6,126,480 A * 10/2000 Kawase et al. ..... 439/489
6,261,116 B1 * 7/2001 Ceru ..... 439/352
6,435,895 B1 * 8/2002 Fink et al. ..... 439/352
6,908,329 B2 * 6/2005 Kozono et al. ..... 439/352
6,918,783 B2 * 7/2005 Endo et al. ..... 439/352
6,935,887 B2 * 8/2005 Endo ..... 439/489
7,252,530 B2 * 8/2007 Shamoto ..... 439/352
7,326,074 B1 * 2/2008 Lim et al. ..... 439/352
7,591,668 B2 * 9/2009 Nakamura ..... 439/489
7,909,638 B2 * 3/2011 Seo et al. ..... 439/489
8,016,606 B1 * 9/2011 Kwan et al. ..... 439/352

FOREIGN PATENT DOCUMENTS

EP 1 369 964 A1 12/2003

OTHER PUBLICATIONS

International Search Report, International Application No. PCT/US2013/031846, International Filing Date, Mar. 15, 2013.

* cited by examiner

*Primary Examiner* — Thanh Tam Le

(57) ABSTRACT

An electrical connector is provided for mating with a mating connector and includes a housing and a fulcrum latch mechanism having a latch arm extending from a latching end to an actuation end. The latch arm is configured to rotate about a fulcrum that is located along the length of the latch arm between the latching and actuation ends such that the latching end is configured to move between a latched position and an unlatched position. A connector position assurance (CPA) device is movably held by the housing such that the CPA device is configured to move relative to the housing between a mated position and an unmated position. The CPA device is movably held by the housing independently of the latch arm.

20 Claims, 7 Drawing Sheets

ELECTRICAL CONNECTOR WITH CONNECTOR POSITION ASSURANCE DEVICE

BACKGROUND OF THE INVENTION

The subject matter herein relates generally to electrical connectors having connector position assurance (CPA) devices.

Some known electrical connectors include CPA devices that indicate whether the electrical connector is fully mated with a mating connector. Specifically, CPA devices provide visual and/or mechanical assurance of the relative positions of the connectors to verify that the connectors are fully mated together. For example, a CPA device may emit an audible click and/or a tactile feel that indicates the connectors are fully mated together. An additional functionality of at least some CPA devices is preventing the connectors from being inadvertently unlatched and thereby separated (i.e., unmated).

Some known electrical connectors having CPA devices include a fulcrum latch. Fulcrum latches include a latch arm that rotates about a fulcrum in the same manner as a seesaw. But, the CPA devices of electrical connectors that include fulcrum latches are integrated into the fulcrum latch, which may limit or prevent the fulcrum latch and/or the CPA device from emitting an audible click and/or tactile feel that indicates that the connectors are fully mated together.

A need remains for an electrical connector having a fulcrum latch and a CPA device wherein the fulcrum latch and/or the CPA device is capable of indicating with an audible click and/or tactile feel that the electrical connector is fully mated with a mating connector.

BRIEF DESCRIPTION OF THE INVENTION

In one embodiment, an electrical connector is provided for mating with a mating connector. The electrical connector includes a housing and a fulcrum latch mechanism having a latch arm extending from a latching end to an actuation end. The latch arm is configured to rotate about a fulcrum that is located along the length of the latch arm between the latching and actuation ends. The latch arm is configured to rotate about the fulcrum such that the latching end is configured to move between a latched position and an unlatched position. The electrical connector also includes a connector position assurance (CPA) device. The CPA device is movably held by the housing such that the CPA device is configured to move relative to the housing between a mated position and an unmated position. The CPA device is movably held by the housing independently of the latch arm.

In another embodiment, an electrical connector assembly includes a mating connector having a latch, and an electrical connector configured to mate with the mating connector. The electrical connector includes a housing and a fulcrum latch mechanism having a latch arm extending from a latching end to an actuation end. The latch arm is configured to rotate about a fulcrum that is located along the length of the latch arm between the latching and actuation ends. The latch arm is configured to rotate about the fulcrum such that the latching end is configured to move between a latched position and an unlatched position. The electrical connector also includes a connector position assurance (CPA) device. The CPA device is movably held by the housing such that the CPA device is configured to move relative to the housing between a mated position and an unmated position. The CPA device is movably held by the housing independently of the latch arm.

DETAILED DESCRIPTION OF THE INVENTION

Figure 1:
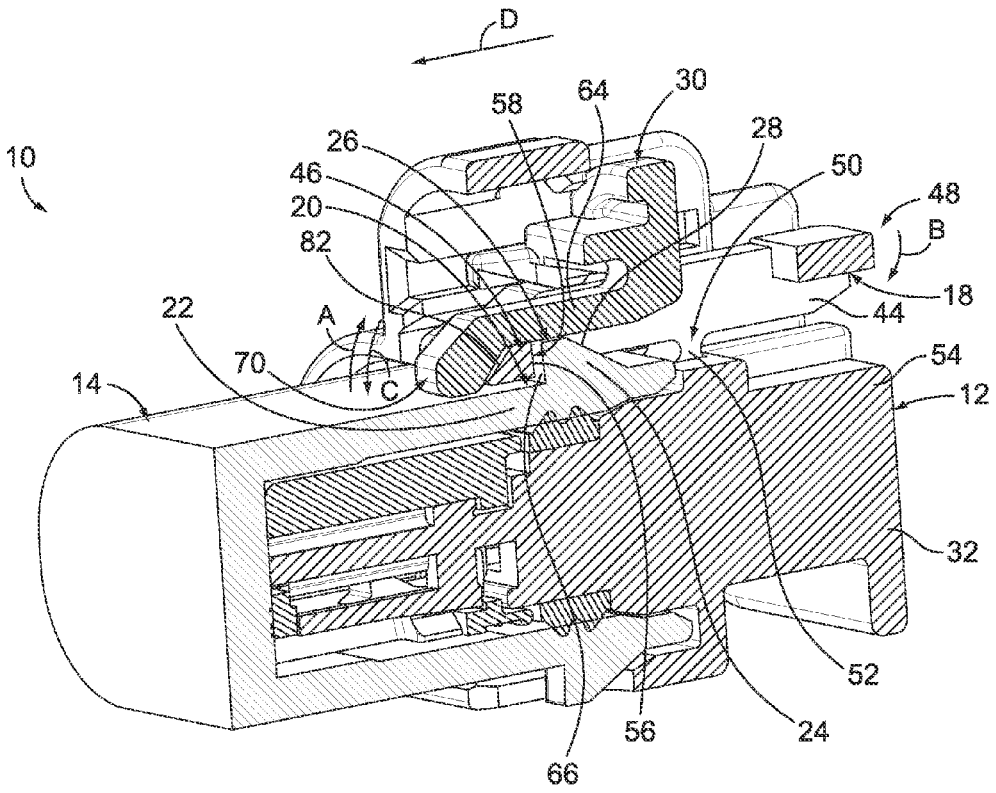
FIG. 1 is a perspective view illustrating a cross section of an exemplary embodiment of an electrical connector assembly.

FIG. 1 is a perspective view illustrating a cross section of an exemplary embodiment of an electrical connector assembly 10. The assembly 10 includes an electrical connector 12 and a mating connector 14. The connectors 12 and 14 are configured to be mated together to establish an electrical connection therebetween. Specifically, the electrical connector 12 includes one or more electrical contacts 16 (FIG. 2) that mate with one or more electrical contacts (not shown) of the mating connector 14 to electrically connect the electrical connector 12 to the mating connector 14. Each of the connectors 12 and 14 may terminate to, be mounted to, and/or otherwise form part of any type of electrical device. For example, the electrical connector 12 and/or the mating connector 14 may terminate an electrical cable (not shown). Moreover, and for example, the electrical connector 12 and/or the mating connector 14 may be mounted to a printed circuit board (not shown). Another example includes mounting the electrical connector 12 and/or the mating connector 14 to another connector, such as, but not limited to, a header connector. The mating connector 14 may include any number of electrical contacts.

The electrical connector 12 includes a fulcrum latch mechanism 18 and the mating connector 14 includes a latch 20. The fulcrum latch mechanism 18 and the latch 20 cooperate to latch the connectors 12 and 14 together in the mated position. The latch 20 of the mating connector 14 includes a latch member 22 having a locking ramp 24. The locking ramp 24 extends outwardly from the latch member 22 to a free end 26. In the exemplary embodiment, the locking ramp 24 includes a ramp surface 28 that extends between the latch member 22 and the free end 26. The fulcrum latch mechanism 18 of the electrical connector 12 is described below with reference to FIGS. 1 and 4. Cooperation of the fulcrum latch mechanism 18 and the latch 20 to latch the connectors 12 and 14 together is described below with reference to FIG. 1.

The electrical connector 12 includes a connector position assurance (CPA) device 30 that is configured to indicate whether the connectors 12 and 14 are fully mated together. The CPA device 30 may also facilitate preventing inadvertent separation (i.e., unmating) of the connectors 12 and 14. As described in more detail below, the CPA device 30 is movably held by a housing 32 of the electrical connector 12 independently of the fulcrum latch mechanism 18.

Figure 2:
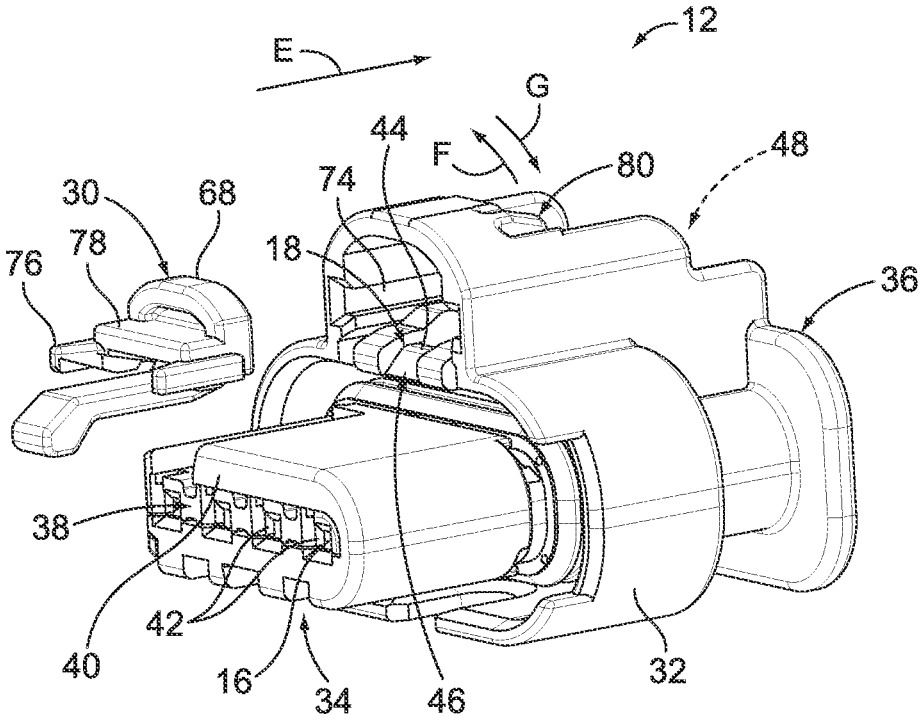
FIG. 2 is a partially exploded front perspective view of an exemplary embodiment of an electrical connector of the electrical connector assembly shown in FIG. 1.
Figure 3:
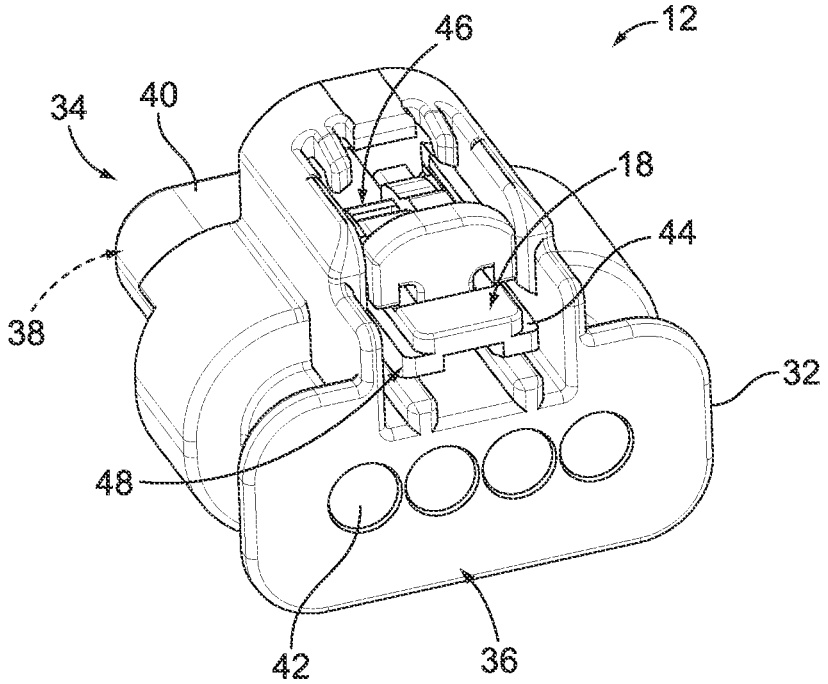
FIG. 3 is a rear perspective view of the electrical connector shown in FIG. 2.
Figure 7:
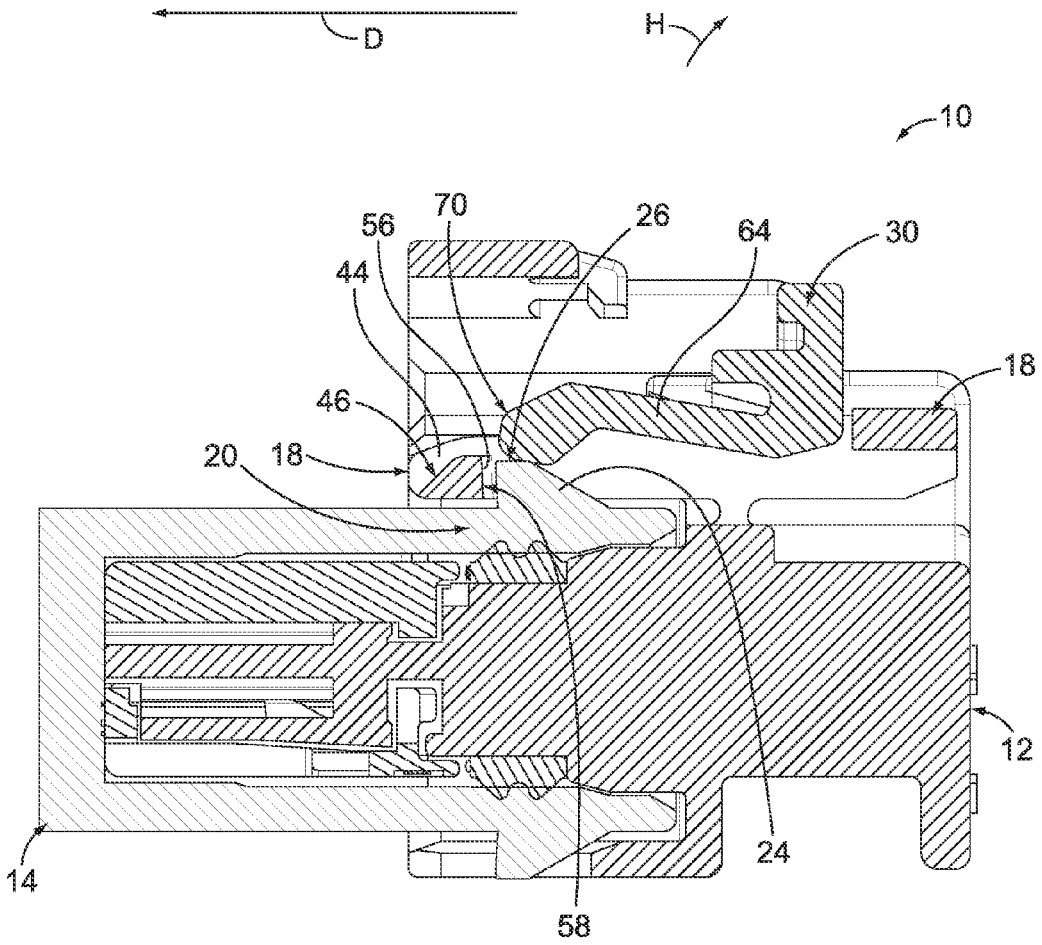
FIG. 7 is a cross-sectional view of the electrical connector assembly shown in FIG. 1 illustrating operation of the CPA device shown in FIG. 5.
Figure 8:
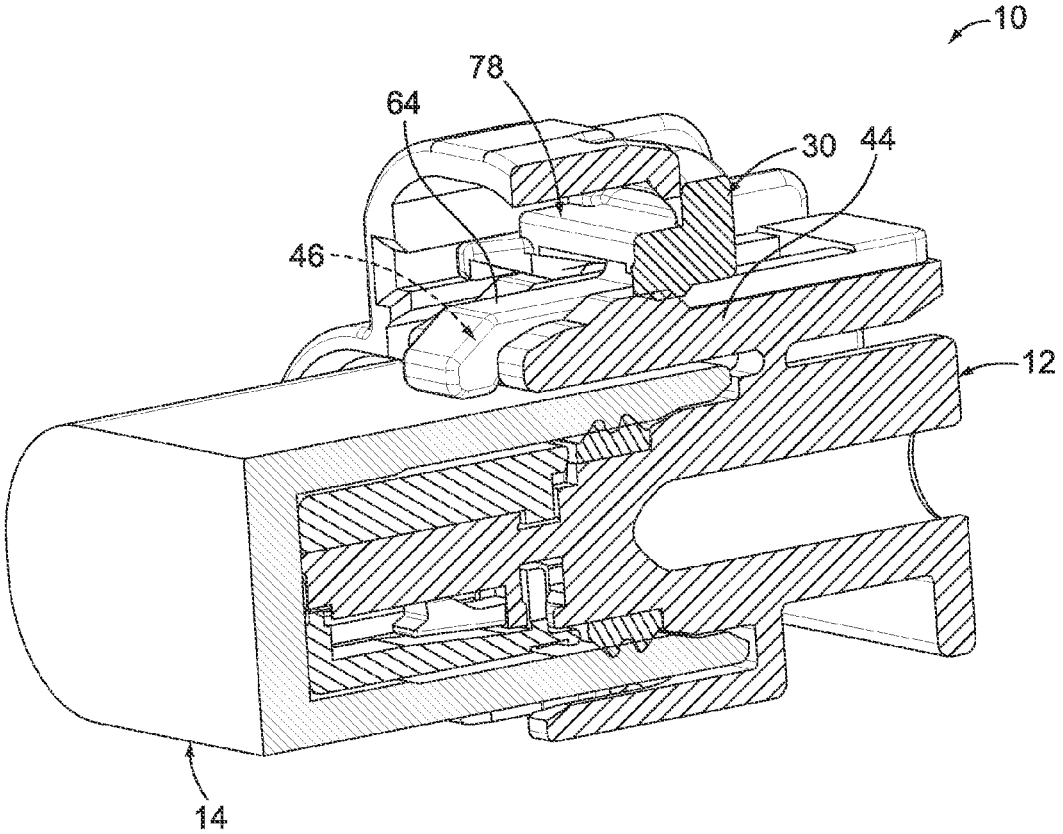
FIG. 8 is another perspective view illustrating a cross section of the electrical connector assembly shown in FIGS. 1 and 7.

FIG. 2 is a partially exploded front perspective view of an exemplary embodiment of the electrical connector 12. FIG. 3 is a rear perspective view of the electrical connector 12. Referring now to FIGS. 2 and 3, the electrical connector 12 includes the housing 32, which extends from a front 34 to a rear 36. In the exemplary embodiment, the front 34 of the housing 32 includes a plug 38 that is configured to be received by the mating connector 14 (FIGS. 1, 7, and 8). An optional shroud 40 extends around a portion of the plug 38 of the housing 32. One or more contact cavities 42 extend into the housing 32. In the exemplary embodiment, the contact cavities 42 extend into the plug 38, as can be seen in FIG. 2. Each contact cavity 42 holds one or more of the electrical contacts 16 (not visible in FIG. 3) therein. The contact cavities 42 are configured to receive corresponding electrical contacts of the mating connector 14 therein such that the electrical contacts of the mating connector 14 mate with the corresponding electrical contacts 16 within the contact cavities 42. Although four are shown, electrical connector 12 may include any number of the contact cavities 42. Moreover, the electrical connector 12 may include any number of the electrical contacts 16.

As can be seen in FIG. 3, in the exemplary embodiment, the contact cavities 42 extend through the rear 36 of the housing 32. The exemplary embodiment of the electrical connector 12 is configured to terminate an electrical cable (not shown). Specifically, the contact cavities 42 are configured to receive one or more electrical wires (not shown) of the electrical cable at the rear 36 of the housing 32. The electrical contacts 16 are configured to be terminated to the electrical wires to establish an electrical connection between the electrical connector 12 and the electrical cable.

Referring again to FIGS. 2 and 3, the electrical connector 12 includes the fulcrum latch mechanism 18. The fulcrum latch mechanism 18 includes a latch arm 44 that extends from a latching end 46 to an actuation end 48. As will be described below, the latch arm 44 is configured to rotate about one or more fulcrums 50 (FIGS. 1 and 4) to move the latching end 46 between a latched position and an unlatched position. The actuation end 48 is moved (e.g., pressed by a user) to actuate rotation of the latch arm 44, in a direction that moves the latching end 46 from the latched position to the unlatched position. The latching end 46 of the latch arm 44 is shown in the latched position in FIGS. 2 and 3.

In the exemplary embodiment, and as should be apparent from at least FIGS. 1-4, the fulcrum latch mechanism 18, and specifically the latch arm 44, is integrally formed with the housing 32. But, the latch arm 44 may alternatively be a discrete component from the housing 32 that is held by the housing 32.

Figure 4:
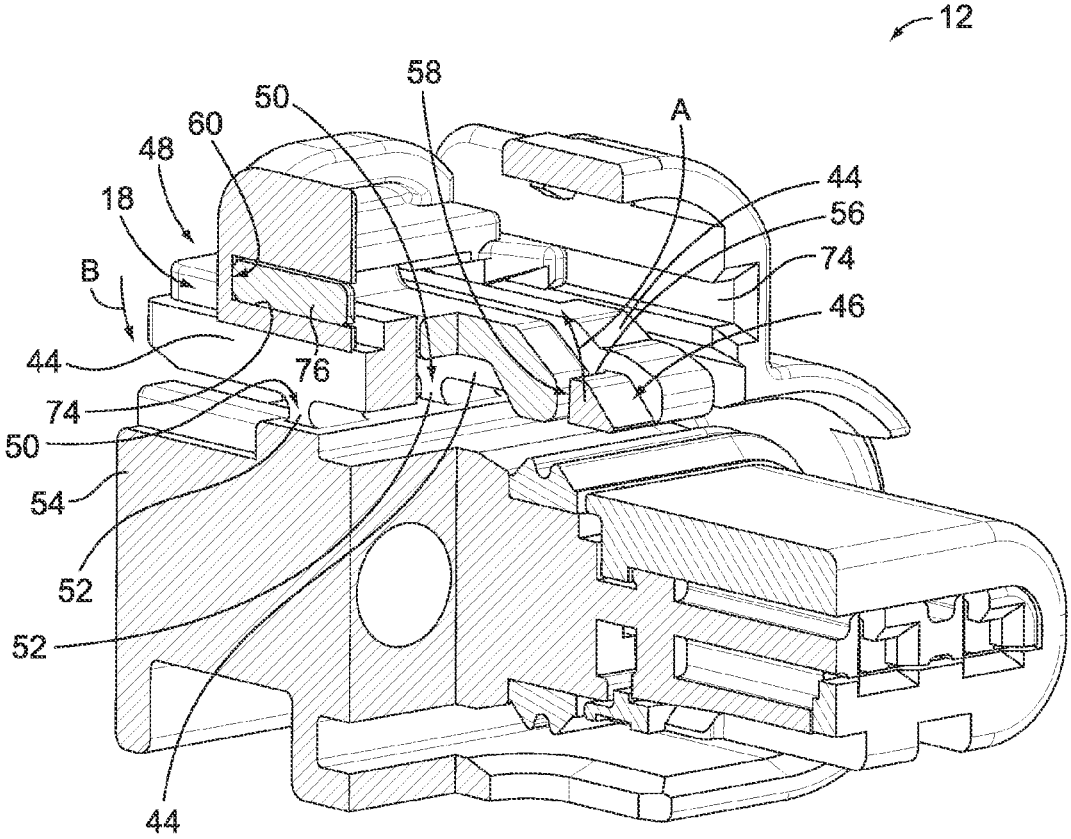
FIG. 4 is a perspective view illustrating a cross section of the electrical connector shown in FIGS. 2 and 3.

FIG. 4 is a perspective view illustrating a cross section of the electrical connector 12. Referring now to FIGS. 1 and 4, the fulcrum latch mechanism 18 of the electrical connector 12 is described in more detail. The latch arm 44 is shown in the latched position in FIGS. 1 and 4. In the exemplary embodiment, each fulcrum 50 is a strip of material 52 that connects the latch arm 44 to a base 54 of the housing 32. Each fulcrum 50 is located along the length of the latch arm 44 between the latching end 46 and the actuation end 48. In the exemplary embodiment, each fulcrum 50 is located at an approximate midpoint of the length of the latch arm 44. But, each fulcrum 50 may be located at any location along the length of the latch arm 44 that enables the latching end 46 to move between the latched and unlatched positions and that enables the actuation end 48 to be actuated to move the latching end 46 from the latched position to the unlatched position. The fulcrum arrangement of the fulcrum latch mechanism 18 may also be referred to as a "seesaw" arrangement, such that the fulcrum latch mechanism 18 may be referred to as a "seesaw latch mechanism".

The latching end 46 of the latch arm 44 includes an opening 56. As can be seen in FIG. 1, the opening 56 receives the locking ramp 24 of the latch 20 of the mating connector 12 therein when the latch arm 44 is in the latched position and the fulcrum latch mechanism 18 and the latch 20 are latched together. The electrical connector 12 includes a front stop 58 and a rear stop 60. Specifically, the latching end 46 of the latch arm 44 includes the front stop 58, while the housing 32 includes the rear stop 60. The opening 56 and the front stop 58 can also be seen in FIG. 5.

The latch arm 44 is configured to rotate about the fulcrums 50 to move the latching end 46 between the latched and unlatched positions. Specifically, the latch arm 44 is biased to the latched position shown in FIG. 1. The latch arm 44 is configured to rotate about the fulcrums 50 to move the latching end 46 in the direction of the arc A from the latched position to the unlatched position. The actuation end 48 of the latch arm 44 can be used to actuate rotation of the latch arm 44 and thereby move the latching end 46 in the direction of the arc A by moving the actuation end 48 of the latch arm 44 in the direction of the arc B, for example by pressing on the actuation end 48 using a person's finger and/or palm.

Referring now solely to FIG. 1, operation of the fulcrum latch mechanism 18 to latch the connectors 12 and 14 together will be described. As the connectors are brought together, the ramp surface 28 of the locking ramp 24 of the mating connector latch 20 engages the latching end 46 of the latch arm 44 of the electrical connector 12. The locking ramp 24 moves the latching end 46, against the bias of the latch arm 44 to the latched position, in the direction of the arc A from the latched position to the unlatched position. Once a latching surface 66 of the locking ramp 24 has cleared the front stop 58, the bias of the latch arm 44 moves the latching end 46 in the direction of the arc C from the unlatched position to the latched position. Movement of the latching end 46 from the unlatched position to the latched position and reception of the locking ramp 24 within the opening 56 may emit an audible click and/or tactile feel that indicates that the connectors 12 and 14 are latched together. When the connectors 12 and 14 are latched together as shown in FIG. 1, the connectors 12 and 14 are fully mated together. By "fully mated together", it is meant that the electrical contacts 16 of the electrical connector 12 are sufficiently engaged with the electrical contacts of the mating connector 14 such that an electrical connection is established between the electrical contacts, and thereby between the connectors 12 and 14.

As can be seen in FIG. 1, engagement between the front stop 58 and the latching surface 66 of the latch 20 will prevent the connectors 12 and 14 from being separated (i.e., unmated), such that the connectors 12 and 14 are latched together. To unmate the connectors 12 and 14, the actuation end 48 of the latch arm 44 can be moved in the direction of the arc B to thereby move the latching end 46 from the latched position to the unlatched position.

Figure 5:
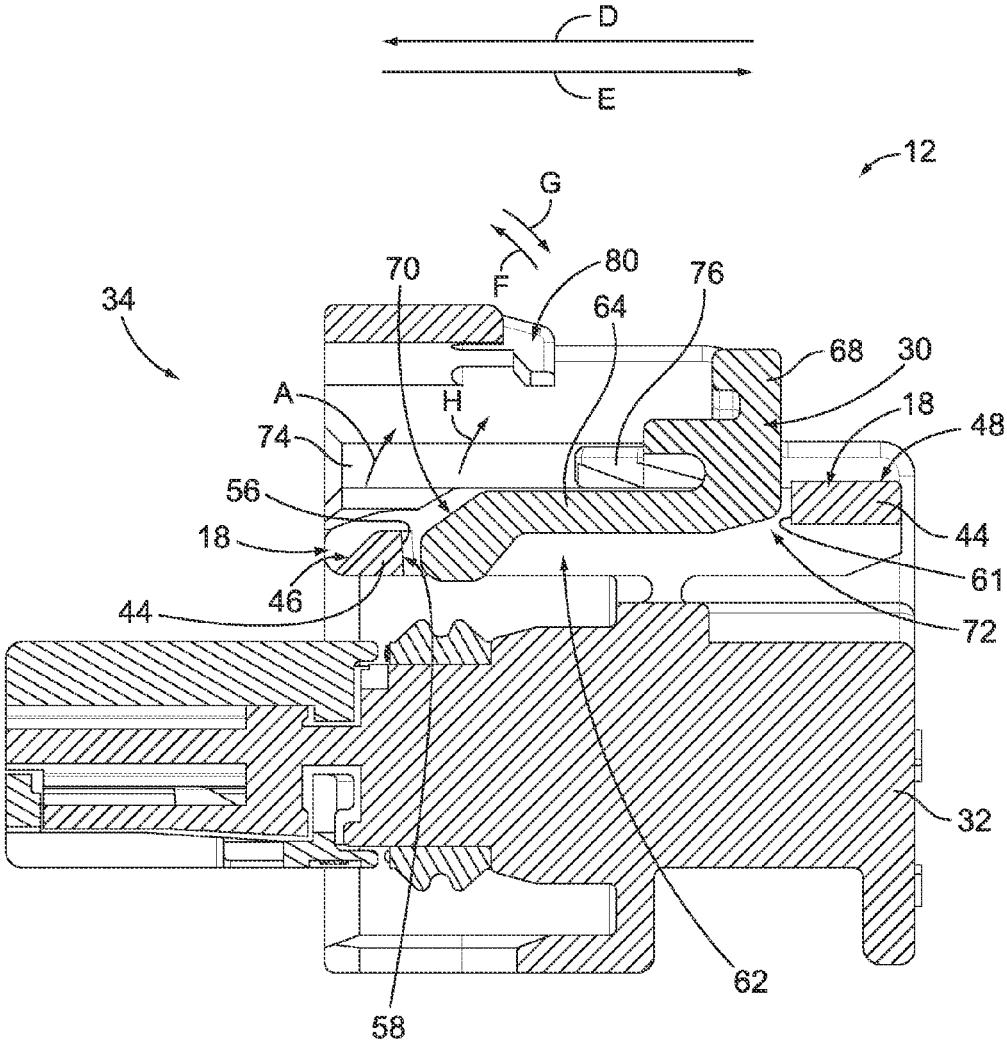
FIG. 5 is a cross-sectional view of the electrical connector shown in FIGS. 2-4 illustrating an exemplary embodiment of a connector position assurance (CPA) device.

FIG. 5 is a cross-sectional view of the electrical connector 12 illustrating an exemplary embodiment of the CPA device 30. The CPA device 30 includes an indication member 64 and a handle 68. The CPA device 30 is movably held by the housing 32 such that the CPA device 30 is configured to move relative to the housing 32 between a mated position and the unmated position. The CPA device 30 is shown in the unmated position in FIG. 5. The mated position of the CPA device 30 is shown in FIGS. 1 and 8. The indication member 64 of the CPA device 30 is configured to move in the direction of the arrow D from the unmated position to the mated position. In the mated position, the indication member 64 is configured to indicate that the connectors 12 and 14 are fully mated together, as will be described below. The unmated position of the CPA device 30 shown in FIG. 5 may be a "pre-staged" or "shipping" position. For example, the electrical connector 12 may be shipped or otherwise transported with the CPA device 30 in the unmated position shown in FIG. 5, which may facilitate preventing damage to the CPA device 30 and/or may facilitate preventing the CPA device 30 from being separated (i.e., lost) from the remainder of the electrical connector 12.

The indication member 64 of the CPA device 30 extends a length from an end 70 to an opposite end 72. The handle 68 of the CPA device 30 extends generally perpendicular to the indication member 64 at the end 72. The end 70 of the indication member 64 is resiliently deflectable, against a bias thereof, in the direction of the arc H. When the indication member 64 is in the unmated position as shown in FIG. 5, the end 70 of the indication member 64 extends within the opening 56 of the latching end 46 of the latch arm 44 and the indication member 64 is held within a channel 62 that extends between the front stop 58 and a front surface 61 of the actuation end 48 of the latch arm 44. In such a position, the front stop 58 and the rear stop 60 (FIG. 4) restrain movement of the indication member 64 within the channel 62 in the directions of the arrows D and E, respectively. The front surface 61 of the actuation end 48 of the latch arm 44 may also restrain movement of the indication member 64 within the channel 62 in the direction of the arrow E when the latch arm 44 is in the latched position.

Figure 6:
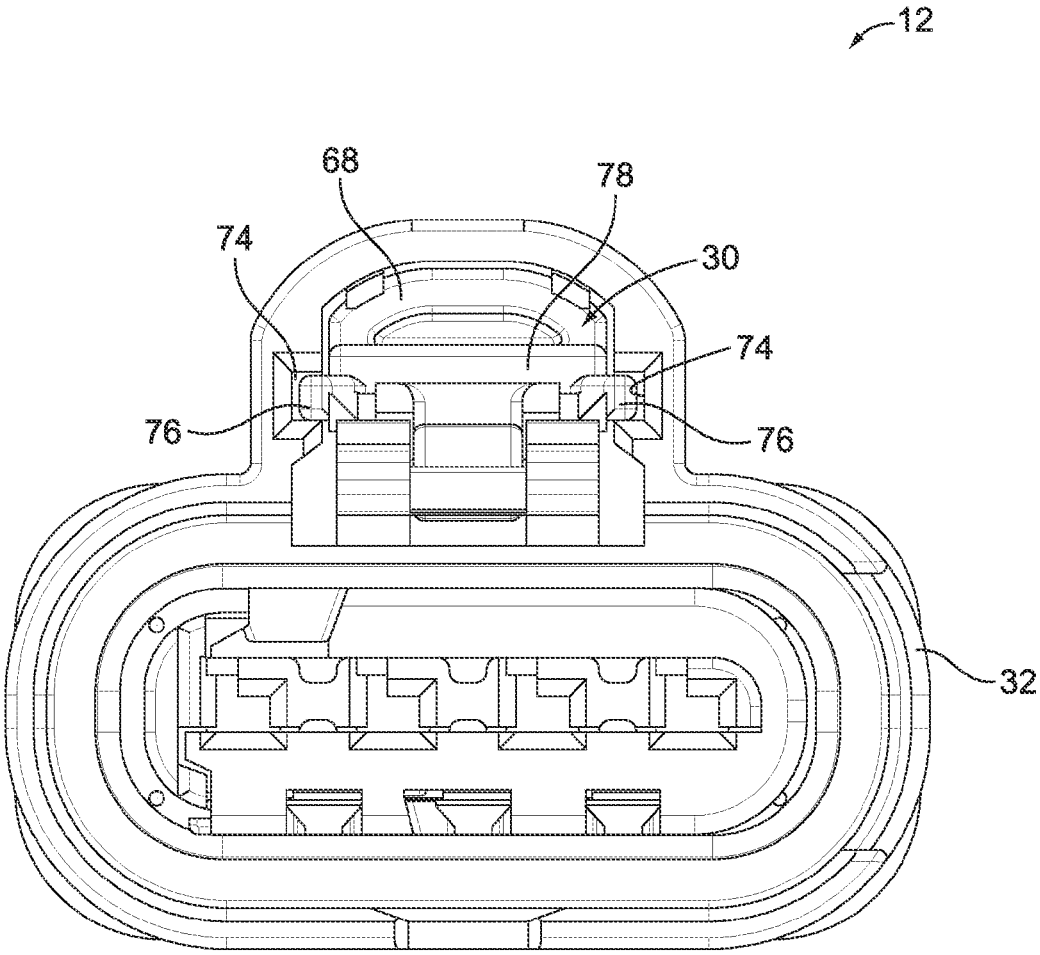
FIG. 6 is a front elevational view of the electrical connector shown in FIGS. 2-5.

The CPA device 30 is movably held by the housing 32 independently of the latch arm 44 of the fulcrum latch mechanism 18. For example, FIG. 6 is a front elevational view of the electrical connector 12 that illustrates how the CPA device 30 is movably held by the housing 32. In the exemplary embodiment, the housing 32 includes one or more guide rails 74 and the CPA device 30 includes one or more guide members 76. The guide members 76 extend outwardly from a guide base 78 of the CPA device 30, which extends from the handle 68 in the exemplary embodiment. Although the housing 32 may include any number of the guide rails 74 and the CPA device 30 may include any number of guide members 76, in the exemplary embodiment the housing 32 includes two opposing guide rails 74 that each receives a corresponding guide member 76 therein. The guide rails 74 and the guide members 76 can also be seen in FIGS. 2 and 4.

Referring again to FIG. 5, the guide members 76 are configured to slide within the guide rails 74 in the directions D and E to move the CPA device 30 in the directions D and E and thereby between the mated and unmated positions. The guide rails 74 of the housing 32 are separate structures from the fulcrum latch mechanism 18. For example, the guide rails 74 are separate structures from the latch arm 44 of the fulcrum latch mechanism 18. The cooperation between the guide rails 74 and the guide members 76 enables the CPA device 30 to move relative to the housing 32 independently of the latch arm 44. The structure (i.e., the guide rails 74) that enables and guides movement of the CPA device 30 relative to the housing 32 is not a structure of the fulcrum latch mechanism 18. Moreover, the latching end 46 of the latch arm 44 of the fulcrum latch mechanism 18 is configured to move between the latched and unlatched positions without disturbing the CPA device 30 (e.g., without disturbing the indication member 64). The CPA device 30 does not move with the latch arm 44 as the latching end 46 of the latch arm 44 moves between the latched and unlatched positions. For example, when the indication member 64 of the CPA device 30 is in the unmated position as shown in FIG. 5, the latching end 46 can move in the direction of the arc A from the latched position shown in FIG. 5 to the unlatched position without disturbing the indication member 64. Moreover, and for example, when the indication member 64 of the CPA device 30 is in the unmated position as shown in FIG. 5, the indication member 64 will not move with the latch arm 44 as the latching end 46 moves in the direction of the arc A from the unlatched position to the latched position.

The housing 32 of the electrical connector 12 includes a stop 80. The stop 80 is configured to engage the handle 68 of the CPA device 30 when the CPA device 30 is in the mated position to restrain further movement of the CPA device 30 in the direction of the arrow D. The stop 80 may be resiliently deflectable in the direction of the arc F from the position shown in FIG. 5, which enables the CPA device to be loaded to the housing 32 from (i.e., through) the front 34 of the housing 32. Specifically, and referring now to FIGS. 2 and 5, the CPA device 30 can be loaded to the housing 32 by moving the CPA device 30 in the direction of the arrow E from the position of the CPA device 30 shown in FIG. 2. As the CPA device moves in the direction of the arrow E, the handle 68 engages the stop 80 and deflects the stop 80, against the bias thereof, in the direction of the arc F. Once the handle 68 has cleared the stop 80, the bias of the stop 80 moves the stop 80 in the direction of the arc G to the position shown in FIG. 5, wherein the stop 80 restrains the CPA device 30 from being unloaded from the front 34 of the housing 32.

FIG. 7 is a cross-sectional view of the electrical connector assembly 10 illustrating operation of the CPA device 30. As shown in FIG. 7, the connectors 12 and 14 are latched together using the fulcrum latch mechanism 18 and the latch 20. During latching of the connectors 12 and 14 together, the locking ramp 24 of the latch 20 of the mating connector 14 is received within the opening 56 of the latching end 46 of the latch arm 44. As the locking ramp 24 is received into the opening 56, the free end 26 of the locking ramp 24 engages the end 70 of the indication member 64 and deflects the end 70, against the bias thereof, in the direction of the arc H. As should be apparent from FIG. 7, the deflection of the end 70 of the indication member 64 does not disturb the latch arm 44. In other words, the latch arm 44 does not move along with the end 70 of the indication member 64 as the end 70 is deflected in the direction of the arc H.

Before the mating connector 14 was fully mated with the electrical connector 12 and the locking ramp 24 was received into the opening 56, the front stop 58 prevented the CPA device 30 from being moved from the unmated position to the mated position. But, as can be seen in FIG. 7, the end 70 of the indication member 64 is deflected by the locking ramp 24 a sufficient amount in the direction of the arc H such that the end 70 can clear the front stop 58. Accordingly, once the locking ramp 24 has deflected the end 70 of the indication member 64 as shown in FIG. 7, the CPA device 30 can be moved in the direction of the arrow D from the unmated position to the mated position.

Referring again to FIG. 1, as the CPA device 30 is moved in the direction of the arrow D from the unmated position shown in FIG. 7 to the mated position shown in FIG. 1, the bias of the end 70 of the indication member 64 causes the end 70 to snap over the front stop 58. As can be seen in FIG. 1, when the CPA device 30 is in the mated position, the end 70 has been fully snapped over the stop front 58 such that the end 70 extends over a rear surface 82 of the front stop 58. The snapping action of the end 70 of the indication member 64 emits an audible click and/or tactile feel that indicates that the CPA device 30 is in the mated position.

Because the end 70 must be deflected by the locking ramp 24 to enable the CPA device 30 to move from the unmated position to the mated position, the CPA device 30 cannot be moved from the unmated position to the mated position unless the connectors 12 and 14 are fully mated together. Successful movement of the CPA device 30 to the mated position thus indicates that the connectors 12 and 14 are fully mated together. Accordingly, the audible click and/or tactile feel emitted by the indication member 64 as the CPA device 30 arrives at the mated position indicates that the connectors 12 and 14 are fully mated together.

As described above, the CPA device 30 may facilitate preventing inadvertent separation (i.e., unmating) of the connectors 12 and 14. FIG. 8 is another perspective view illustrating a cross section of the electrical connector assembly 10. In the exemplary embodiment, the guide base 78 of the CPA device 30 engages the latch arm 44 when the CPA device 30 is in the mated position. As should be apparent from FIG. 8, the engagement between the guide base 78 and the latch arm 44 holds the latching end 46 of the latch arm 44 in the latched position, which thereby holds the locking ramp 24 (FIGS. 1 and 7) of the mating connector 14 within the opening 56 (FIGS. 1 and 7) of the latch arm 44. Accordingly, when the CPA device 30 is in the mated position, the CPA device 30 prevents inadvertent separation of the connectors 12 and 14 by preventing the connectors 12 and 14 from being unlatched from each other.

The embodiments described and/or illustrated herein provide an electrical connector having a fulcrum latch mechanism and a CPA device, wherein the fulcrum latch mechanism and/or the CPA device is capable of indicating that the electrical connector is fully mated with a mating connector. For example, the embodiments described and/or illustrated herein provide an electrical connector having a fulcrum latch mechanism and a CPA device, wherein the fulcrum latch mechanism and/or the CPA device emits an audible click and/or tactile feel that indicates that the electrical connector is fully mated with a mating connector.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector for mating with a mating connector having a latch that includes a latch member having a locking ramp, the electrical connector comprising:

a housing;

a fulcrum latch mechanism comprising a latch arm extending from a latching end to an actuation end, the latch arm being configured to rotate about a fulcrum that is located along the length of the latch arm between the latching and actuation ends, the latch arm being configured to rotate about the fulcrum such that the latching end is configured to move between a latched position and an unlatched position; and a connector position assurance (CPA) device, the CPA device being movably held by the housing such that the CPA device is configured to move relative to the housing between a mated position and an unmated position, wherein the CPA device is movably held by the housing independently of the latch arm, and wherein the CPA device does not move with the latch arm as the latching end of the latch arm moves between the latched and the unlatched positions the CPA device comprising an indication member that is configured to engage and be deflected by the locking ramp of the mating connector when the latch of the mating connector is latched with the fulcrum latch mechanism of the electrical connector.

2. The electrical connector of claim 1, wherein the CPA device cannot be moved from the unmated position to the mated position unless the electrical connector is fully mated with the mating connector.

3. The electrical connector of claim 1, wherein the CPA device comprises a guide base that holds the latching end of the latch arm in the latched position when the CPA device is in the mated position.

4. The electrical connector of claim 1, wherein the latching end of the latch arm comprises a stop, the CPA device comprising an indication member that is resiliently deflectable and is snapped over the stop in the mated position.

5. The electrical connector of claim 1, wherein the housing comprises a guide rail, the CPA device comprising a guide member that is received within the guide rail, the CPA device being movably held by the housing independently of the latch arm using the guide rail such that the guide member slides within the guide rail to move the CPA device between the mated and unmated positions.

6. The electrical connector of claim 1, wherein the housing extends from a front to a rear and comprises a resiliently deflectable stop, the CPA device being configured to be loaded to the housing from the front of the housing by deflecting the stop, wherein the stop restrains the CPA device from being unloaded from the front of the housing once the CPA device has cleared the stop.

7. The electrical connector of claim 1, wherein the latching end of the latch arm is configured to move between the latched and unlatched positions without disturbing the CPA device.

8. The electrical connector of claim 1, wherein the latching end of the latch arm comprises an opening, the CPA device comprising an indication member that is received within the opening when the CPA device is in the unmated position.

9. The electrical connector of claim 1, wherein the CPA device emits at least one of an audible click or a tactile feel when the CPA device is moved to the mated position.

10. The electrical connector of claim 1, wherein the latching end of the latch arm comprises a stop, the CPA device comprising an indication member that is resiliently deflectable and is snapped over the stop in the mated position, the indication member emitting at least one of an audible click or a tactile feel when the indication member is snapped over the stop.

11. The electrical connector of claim 1, wherein the latch arm of the fulcrum latch mechanism is integrally formed with the housing.

12. The electrical connector of claim 1, wherein the fulcrum is spaced apart from both the latching end and the actuation end along the length of the latch arm.

13. The electrical connector of claim 1, wherein the fulcrum is located at an approximate midpoint of the length of the latch arm.

14. The electrical connector of claim 1, wherein the latch arm of the fulcrum latch mechanism is configured to engage and be deflected by the locking ramp of the mating connector to move the latching end between the latched and unlatched positions.

15. An electrical connector assembly comprising:

a mating connector having a latch that includes a latch member having a locking ramp; and an electrical connector configured to mate with the mating connector, the electrical connector comprising:

a housing;

a fulcrum latch mechanism comprising a latch arm extending from a latching end to an actuation end, the latch arm being configured to rotate about a fulcrum that is located along the length of the latch arm between the latching and actuation ends, the latch arm being configured to rotate about the fulcrum such that the latching end is configured to move between a latched position and an unlatched position; and a connector position assurance (CPA) device, the CPA device being movably held by the housing such that the CPA device is configured to move relative to the housing between a mated position and an unmated position, wherein the CPA device is movably held by the housing independently of the latch arm, and wherein the CPA device does not move with the latch arm as the latching end of the latch arm moves between the latched and the unlatched positions the CPA device comprising an indication member that is engaged with and deflected by the locking ramp when the latch of the mating connector is latched with the fulcrum latch mechanism of the electrical connector.

16. The electrical connector assembly of claim 15, wherein the CPA device cannot be moved from the unmated position to the mated position unless the electrical connector and the mating connector are fully mated together.

17. The electrical connector assembly of claim 15, wherein the CPA device comprises a guide base that holds the latching end of the latch arm in the latched position when the CPA device is in the mated position.

18. The electrical connector assembly of claim 15, wherein the latching end of the latch arm comprises a stop, the CPA device comprising an indication member that is resiliently deflectable and is snapped over the stop in the mated position.

19. The electrical connector assembly of claim 15, wherein the fulcrum is located at an approximate midpoint of the length of the latch arm.

20. The electrical connector of claim 15, wherein the latch arm of the fulcrum latch mechanism is configured to engage and be deflected by the locking ramp of the mating connector to move the latching end between the latched and unlatched positions.

* * * * *